US005711729A

United States Patent [19]

Chan

[11] Patent Number: 5,711,729

[45] Date of Patent: Jan. 27, 1998

[54] BALL AND METHODS FOR MAKING THE SAME

[75] Inventor: Raymond Chong Veng Chan, Kowloon, Hong Kong

[73] Assignee: Joyful Long International Ltd., Kowloon, Hong Kong

[21] Appl. No.: 693,414

[22] Filed: Aug. 7, 1996

[51] Int. Cl.[6] ..... A63B 37/12

[52] U.S. Cl. ..... 473/609; 473/600

[58] Field of Search ..... 473/569, 600, 473/601, 602, 603, 604, 605, 606, 609; 264/41, 42, 45.1

[56] References Cited

U.S. PATENT DOCUMENTS

| | | | |
|---|---|---|---|
| 2,138,004 | 11/1938 | Grau, Jr. | 473/600 |
| 2,815,211 | 12/1957 | Grandinette | 473/598 |
| 4,144,297 | 3/1979 | Tomar | 473/600 |
| 4,149,720 | 4/1979 | Heald, Jr. | 473/598 |
| 4,261,565 | 4/1981 | Massino, Sr. | 473/598 |
| 4,367,873 | 1/1983 | Chang et al. | 473/602 |
| 4,462,589 | 7/1984 | Morgan | 473/598 |
| 4,772,019 | 9/1988 | Morgan | 473/601 |
| 4,880,233 | 11/1989 | Song | 473/598 |

*Primary Examiner*—Steven B. Wong

*Attorney, Agent, or Firm*—Fish & Richardson P.C.

[57] ABSTRACT

A ball has a core formed from a sponged and vulcanized mixture of rubber and cork. Methods for making a ball and a ball core are also described.

8 Claims, 4 Drawing Sheets

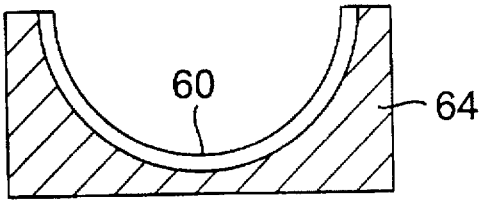
FIG. 4
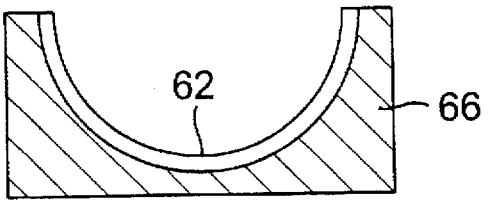
FIG. 4A
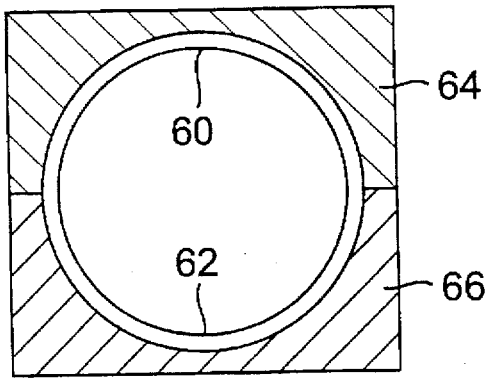
FIG. 4B
FIG. 4C
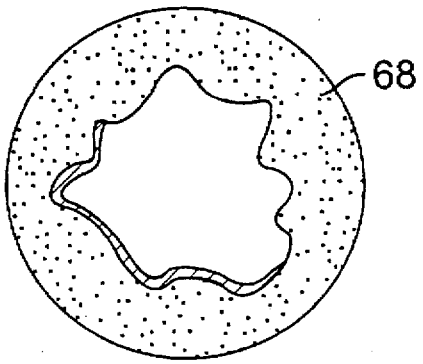

BALL AND METHODS FOR MAKING THE SAME

BACKGROUND OF THE INVENTION

The invention relates to balls, e.g., substitute baseballs, softballs and the like, and to methods for making balls.

Various substitute baseballs and softballs have been proposed to address the need for balls that are safer, i.e. softer, than regulation balls. Regulation baseballs and softballs are quite hard and can cause serious injury, especially to younger and/or inexperienced ballplayers. It is therefore desirable to significantly reduce the chance of injury by providing ball that are softer. It is important, however, to maintain the performance, durability, and the "look and feel" of substitute balls so that they can function as suitable training balls, and so that the players' enjoyment of the game is not diminished by the feeling that the ball is not a regulation ball.

SUMMARY OF THE INVENTION

In one aspect, the invention features a ball comprising a core formed from a sponged and vulcanized mixture of rubber and cork.

In another aspect, the invention features a method of making a ball comprising the steps of: providing a mixture of rubber and cork; extruding the mixture; molding the extruded mixture so that the molded mixture has a spherical surface; and sponging the molded mixture to provide core material.

Embodiments may include one or more of the following features. The core is preferably hollow. The core is preferably formed from two hemispherical shells that are bonded together. The core preferably weighs about 58–210 grams. The core preferably has a generally spherical shape with a diameter of about 5–14 cm. The core preferably has softness of 35–55 type A durometer. The core preferably has a density of 0.15–1 g/cm$^3$. The rubber of the core is preferably natural rubber. A spherical cover preferably surrounds the core. The cover may comprise separate sheets of material stitched together or may be formed from molded rubber. The mixture of rubber and cork preferably comprises a sponging agent (e.g., sodium bicarbonate).

Among the advantages of the invention are the following. Since the core is sponged up from a mixture of rubber and cork, the resulting density of the core can be controlled over a broad range. This allows the amount of rebound or bounce of the ball to be accurately controlled by changing the degree of sponging. The sponged core is softer than cores made from, e.g., solid rubber, and therefore it reduces the chance of injury. Since the density of the sponged core is less than cores made from, e.g., solid rubber, the wall thickness of the hemispherical shells from which the core is made can be increased without adversely increasing the weight. This provides a relatively greater adhesion area between the shells, e.g. as compared to shells of equivalent weight, thereby resisting separation and increasing the durability of the core. As a result of using a mixture of rubber and cork, our inventive core makes a satisfying cracking sound when hit, a sound which more nearly resembles that of a regulation baseball or softball, increasing the players' enjoyment of the game.

Other features and advantages will become apparent from the following description and from the claims.

BRIEF DESCRIPTION OF THE DRAWINGS

FIGS. 4–4C are diagrammatic views of a method of making a core suitable for use in a baseball or a softball.

DESCRIPTION OF THE PREFERRED EMBODIMENTS

Figure 1:
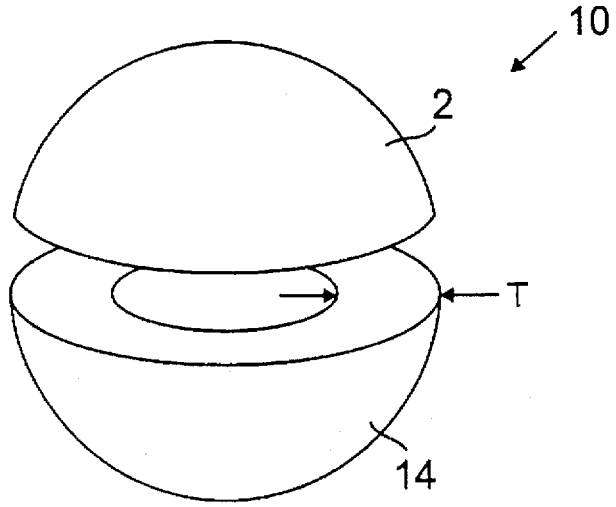
FIG. 1 is a diagrammatic view of a core suitable for use in a baseball or softball.

Referring to FIG. 1, a core 10, suitable for use in a baseball or a softball, is formed from two hemispherical shells 12, 14, each having a wall thickness, T. The two shells 12, 14 are bonded together using an adhesive applied at the interface of the opposed surfaces to form the hollow, spherical core 10.

Figure 2:
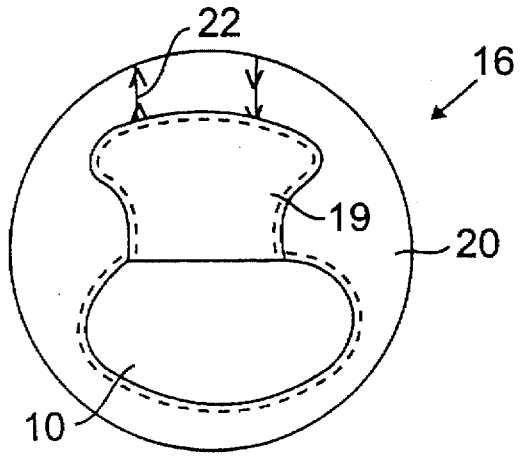
FIG. 2 is a diagrammatic view of a ball that includes a core and a cover formed from two sheets of material that are stitched together.
Figure 2A:
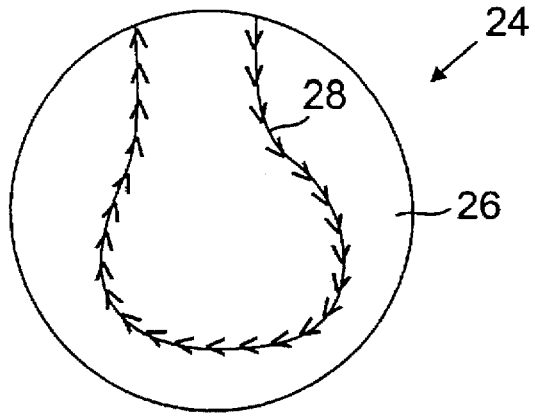
FIG. 2A is a diagrammatic view of a ball that includes a core and a cover formed from molded rubber.

As shown in FIGS. 2 and 2A, core 10 may be covered to form a ball suitable for playing baseball or softball. Ball 16 (FIG. 2) is formed by covering core 10 with two sheets of material 18, 20, such as PVC, leather, or polyurethane, that are stitched together with durable thread 22 (e.g., nylon or vinyl thread). Ball 24 (FIG. 2A) is formed by covering core 10 with a layer of rubber 26 which is molded with a raised stitching pattern 28 to simulate the stitching of a regulation baseball or softball.

Figure 3:
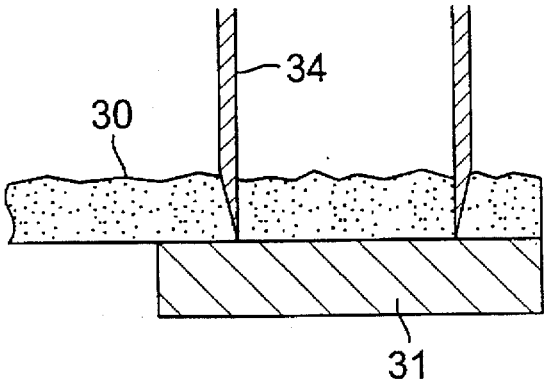
FIGS. 3–3E are diagrammatic views of a method of making a core suitable for use in a baseball or a softball.
Figure 3A:
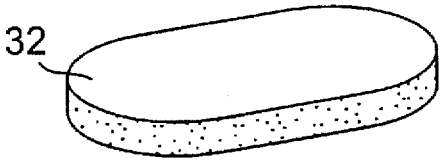
Figure 3B:
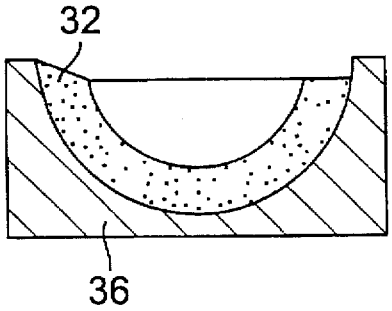
Figure 3C:
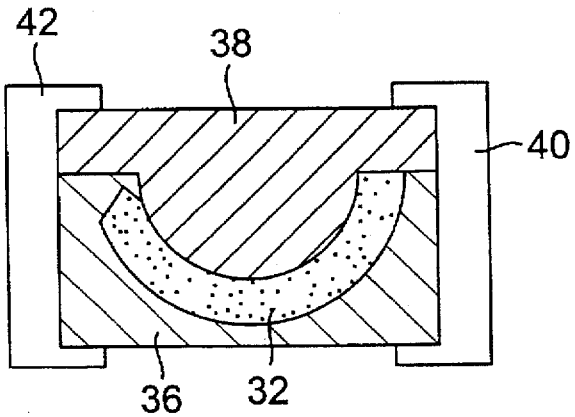
Figure 3D:
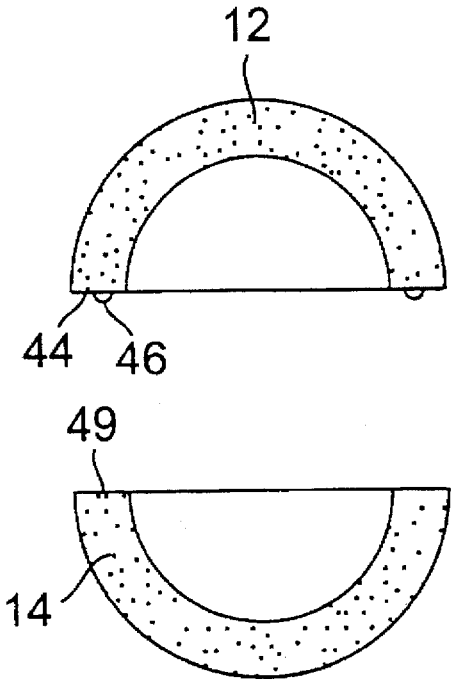
Figure 3E:
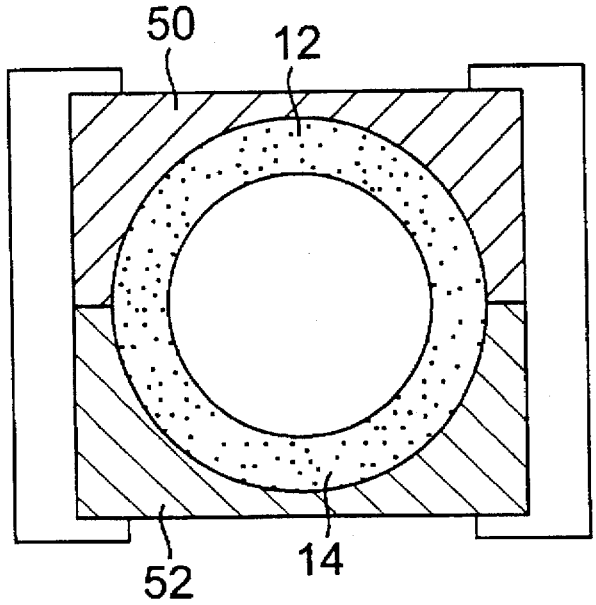

Referring to FIGS. 3–3E, core 10 is formed by the following process. Rubber and cork are mixed together along with other process components by open rolling and kneading (see Example 1, below). The mixture is then extruded into a sheet 30 for curing. As shown in FIG. 3, extruded sheet 30 is passed over a platform 31 and a circular disk 32 (FIG. 3A) is cut from extruded sheet 30 by a cutting die 34. Disk 32 is then placed into a concave hemispherical mold 36 (FIG. 3C). A convex hemispherical mold 38 is pressed against the inside surface of disk 32 and molds 36 and 38 are locked together by clamps 40, 42. The mixture of rubber and cork is then sponged and vulcanized by heating disk 32 in the molds. The molded hemispherical shell is allowed to cool and then removed from the molds. In presently preferred embodiments, the hemispherical shell has a wall thickness of 5–25 mm. As shown in FIG. 3D, the circumferential edge 44 of the resulting hemispherical shell 12 is sanded to provide a smooth surface. A thin contiguous layer of adhesive 46 (e.g., a solvent mixture of gasoline and sulfur) is applied to edge 44 to bond together the circumferential edge 44 of shell 12 to the opposed, circumferential edge 48 of shell 14, which is made by the same process as shell 12. The joined shells are placed in a pair of molds 50, 52 and heated. After the joined shells are cool, the outer surface of the resulting core 10 is buffed and sanded. Core 10 can then be covered by sheets of material that are stitched together, or by a layer of rubber that is molded and vulcanized with a raised stitching pattern over the surface, as described above.

EXAMPLE 1

One mixture of components includes the ingredients and proportions described in the table below.

The molded disk 32 (FIG. 3C) formed from the above mixture is sponged and vulcanized by heating at 140° C. for 20 minutes. The two shells 12, 14 formed from the above mixture are joined together by adhesive and heated in molds 50, 52 (FIG. 3E) at 120° C. for 10 minutes.

| COMPONENT | WEIGHT kg | % WEIGHT |
|---|---|---|
| Natural Rubber | 50 | 31.37 |
| Reclaimed (Natural) Rubber | 50 | 31.37 |
| Dibenzothiazyl Disulfide (DM) | 1.00 | 0.63 |
| 2-Mercaptobenzothiazole (M) | 0.30 | 0.19 |
| Zinc Dimethyl Dithiocarbamate (2DMC) | 0.10 | 0.06 |
| Sulfur (S) | 1.00 | 0.63 |
| Zinc Oxide (ZnO) | 3.00 | 1.88 |
| Strearic Acid | 3.00 | 1.88 |
| Dinitroso-pentamethylene-tetramine | 3.00 | 1.88 |
| Sodium Bicarbonate ($NaHCO_3$) | 3.00 | 1.88 |
| Light Calcium Carbonate ($CaCO_3$) | 10.00 | 6.27 |
| White Oil | 20.00 | 12.55 |
| Cork | 15.00 | 9.42 |
| Total | 159.40 | 100.00 |

Depending on the desired rebound, softness and durability, the amount of natural rubber and cork can vary from the above amounts by ±20%. For example, to obtain a relatively low rebound more cork can be used or, alternatively, larger pieces of cork can be used in the composition. A higher cork content slows the vulcanization process and decreases the sponge rate; this decreases the density of the core material.

The amounts of the other components can be varied as well. For example, greater amounts of 2-mercaptobenzothiazole and zinc dimethyl dithiocarbamate can be used to slow down the vulcanization process, and greater amounts of dinitroso-pentamethylene-tetramine and sodium bicarbonate can be used to increase the sponge rate, which decreases the density of the core and thereby lowers the rebound.

Core Specifications

In embodiments suitable for playing baseball or softball, core 10 has a circumference of 8 inches to 16 inches, a weight of 58 to 210 grams, a softness of 35–55 type A durometer, and a density of 0.15–1 g/cm$^3$. The presently preferred relationship between size and weight of core 10 is provided in the table below.

| | | | | | | |
|---|---|---|---|---|---|---|
| DIAMETER OF CORE (centimeters) | 5.8–7.0 | 6.5–7.5 | 7.5–8.2 | 8.4–9.0 | 9.2–9.8 | 12.2–13.1 |
| WEIGHT OF CORE (grams) | 58–75 | 75–130 | 120–140 | 130–150 | 140–160 | 150–210 |

Other embodiments are within the scope of the claims.

In an alternative core fabrication process, the core is formed as an integral unit by sponging and vulcanizing the core mixture in a spherical mold. Rubber and cork are mixed together along with other process components by open rolling and kneading (see Example 1, above). The mixture is then extruded into a sheet for curing. Two circular disks are cut from the extruded sheet by a cutting die (see, e.g., FIGS. 3 and 3A, above) Referring to FIGS. 4–4C, the circular disks 60, 62 are placed into concave hemispherical molds 64, 66, respectively. As shown in FIG. 4B, molds 64, 66 are then locked together by clamps and the mixture of rubber and cork is sponged and vulcanized by heating disks 60, 62 in the molds. The molded spherical core 68 (shown in partial cross-section in FIG. 4C) is allowed to cool and then removed from the molds. Core 68 can then be covered by sheets of material that are stitched together, or by a layer of rubber that is molded and vulcanized with a raised stitching pattern over the surface, as described above.

Still other embodiments are within the scope of the claims.

What is claimed is:

1. A method of making a ball comprising the steps of:

providing a mixture of rubber containing a distribution of pieces of cork, the rubber forming between about 50.2% to 75.3%, by weight, of the mixture and the pieces of cork forming between about 8.6% to 11.3%, by weight, of the mixture;

extruding said mixture of rubber containing a distribution of pieces of cork;

molding said extruded mixture of rubber containing a distribution of pieces of cork so that said molded mixture has a spherical surface; and sponging said molded mixture of rubber containing a distribution of pieces of cork to provide material suitable for use in a ball.

2. The method of claim 1 wherein said mixture of rubber and cork comprises a sponging agent.

3. The method of claim 2 wherein said sponging agent comprises sodium bicarbonate.

4. The method of claim 1 wherein said step of molding said mixture comprises forming said mixture into a hemispherical shell.

5. The method of claim 4 further comprising the steps of forming two of said hemispherical shells and bonding said two shells together.

6. The method of claim 1 further comprising the step of surrounding said ball material with a cover.

7. The method of claim 6 wherein said surrounding step comprises surrounding said ball material with a rubber layer and vulcanizing said rubber layer.

8. The method of claim 1 wherein the rubber forms about 62.7%, by weight, of the mixture and the pieces of cork form about 9.4%, by weight, of the mixture.

* * * * *